US005161285A

United States Patent [19]

Jerjian

[11] Patent Number: 5,161,285

[45] Date of Patent: Nov. 10, 1992

[54] BUTTON COVER

[75] Inventor: Christopher T. Jerjian, Edgewater, N.J.

[73] Assignee: Dazl, Inc., Fort Lee, N.J.

[21] Appl. No.: 846,826

[22] Filed: Mar. 6, 1992

[51] Int. Cl.[5] ..... A44B 1/00

[52] U.S. Cl. ..... 24/113 R; 24/113 MP; 24/90.5

[58] Field of Search ..... 24/113 R, 113 MP, 90 A, 24/90.5, 92, 90 TA; 40/315

[56] References Cited

U.S. PATENT DOCUMENTS

| | | | |
|---|---|---|---|
| 546,989 | 10/1895 | Baker, Jr. | 24/90.5 |
| 581,111 | 4/1897 | Goodwin . | |
| 995,866 | 6/1911 | Happich et al. | 24/90.5 |
| 1,180,104 | 4/1916 | Barnes | 24/90 A |
| 1,235,575 | 8/1917 | Kliesrath et al. | 24/90.5 |
| 1,267,841 | 5/1918 | Blake | 24/90 A |
| 2,025,663 | 12/1935 | Iuliano | 24/90 TA |
| 2,042,416 | 5/1936 | Weindel, Jr. | 24/113 R |
| 2,751,654 | 6/1956 | Armbruster . | |
| 3,316,601 | 5/1967 | Ryan . | |
| 3,343,230 | 9/1967 | Darvie . | |
| 3,353,231 | 11/1967 | Levine . | |
| 3,584,349 | 12/1969 | Shubart . | |
| 3,777,336 | 12/1973 | Anderson . | |
| 3,934,313 | 1/1976 | Hocq . | |
| 4,539,731 | 9/1985 | Torrini . | |
| 4,918,791 | 4/1990 | Hardin . | |
| 5,060,356 | 10/1991 | Szedzinski . | |

FOREIGN PATENT DOCUMENTS

| | | | |
|---|---|---|---|
| 0527046 | 3/1954 | Belgium | 24/113 MP |

*Primary Examiner*—Victor N. Sakran

*Attorney, Agent, or Firm*—Lerner, David, Littenberg, Krumholtz & Mentlik

[57] ABSTRACT

A detachable ornamental button cover for shirt and blouse buttons, as well as other articles of clothing is constructed to include a number of safety features to prevent inadvertent loss during use. One safety feature designs the direction of opening and closing of the button cover to be transverse to the direction of insertion about the button during use. An additional safety feature includes a restricted elongated slot which frictionally engages the button fastening threads during initial application. The button cover may be constructed from a variety of precious metals and decorated with precious gems and the like.

18 Claims, 1 Drawing Sheet

BUTTON COVER

BACKGROUND OF THE INVENTION

The present invention relates in general to an ornamental cover for a fastening element for clothing articles such as shirt or blouse cuff buttons and the like, and more particularly, to such an ornamental cover which is adapted to be easily and readily mounted and demounted on the button in a manner which prevents inadvertent loss of the cover to achieve a unique ornamental appearance.

Ornamental button covers have been known for quite some time and have taken on a variety of constructions. These known button covers are generally formed from two elements, namely, a cover having an open side for receiving the button and a closure plate for retaining the cover in secured relationship to the button while being worn. Button covers of this type are known from Goodwin, U.S. Pat. No. 581,111; Armbruster, U.S. Pat. No. 2,751,654; Ryan, U.S. Pat. No. 3,316,601; Darvie, U.S. Pat. No. 3,343,230; Levine, U.S. Pat. No. 3,353,231; Shubart, U.S. Pat. No. 3,584,349; Hocq, U.S. Pat. No. 3,934,313; Torrini, U.S. Pat. No. 4,539,731; and Szedzinski, U.S. Pat. No. 5,060,356.

Button covers of the aforementioned type have had traditional application as a decorative accessory for male shirts that when applied over the cuff buttons, simulate the presence of cuff links. The advantage of these button covers, with respect to a traditional cuff link, resides in that they can be used in conjunction with any kind of shirt, without requiring the characteristic pair of button holes necessary when using cuff links. Moreover, these button covers may be used on women's blouse cuffs, as well as other locations for buttons when desired to produce an aesthetically attractive effect.

There is known from Anderson, U.S. Pat. No. 3,777,336, a button cover of the aforementioned type also constructed from a cap and a closure plate. The closure plate is provided with a large central hole communicating with a V-shaped opening forming a pair of projecting legs. In use, the closure plate is slid between the button and shirt cuff so as to receive the button fastening threads within the central hole after they pass through the V-shaped opening. At this time, the cover is closed over the button by hinge action in the direction of placement of the closure plate. That is, the cover is movable between its opened and closed position in the direction of insertion of the closure plate. As a consequence, in the event of inadvertent opening of the cover, the weight of the cover has the tendency to act in the direction of removal of the closure plate from about the button fastening threads, thereby resulting in loss of the button cover. In addition, as the V-shaped opening is relatively large in comparison to the button fastening threads, there is nothing to hold the closure plate in position should the cover open during use. These disadvantages inherent in the button cover of Anderson, are also inherent in the button covers of the aforementioned patents.

There is also known from Hardin, U.S. Pat. No. 4,918,791 a button guard for protecting clothing buttons during cleaning operations. The button guard is constructed as a cylindrical canister closed at one end and having a removable cap at the other. The side wall of the canister is provided with a longitudinal slot communicating with a peripheral V-shaped opening to allow the button guard to slide over the button fastening threads such that the button is completely enclosed within the cylinder upon placement of the cap. The button guard of Hardin, unlike those previously discussed, has no ornamental value and is strictly used to protect the button during the cleaning operation.

SUMMARY OF THE INVENTION

One object of the present invention is to provide a button cover which is ornamental in nature and which is readily mountable and demountable to buttons sewn on shirts, blouses and the like.

Another object of the present invention is to provide a button cover which is readily retained on the button upon inadvertent opening of its cover during use.

Another object of the present invention is to provide a button cover which can be constructed of precious materials such as gold, silver and the like.

Another object of the present invention is to provide a button cover which is simple and economical to construct.

Another object of the present invention is to provide a button cover as an ornamental accessory for shirt cuff buttons and as a substitute for the use of cuff links.

In accordance with one embodiment of the present invention, there is disclosed a button cover comprising a cap having an open side for receiving a button therein, and a closure plate movably attached to the cap, the plate including an elongated slot having a longitudinal axis, the plate movable between an opened and closed position with respect to the open side of the cap by movement of the plate in a direction transverse to the longitudinal axis of the slot.

In accordance with another embodiment of the present invention, there is disclosed a button cover comprising a cap having an open side for receiving a button therein, a closure plate including an elongated slot having a longitudinal axis, the elongated slot communicating at one end with a central opening within the plate and at its other end with an enlarged opening at a peripheral portion of the plate, and connecting means for rotatably connecting the plate to the cap, the plate rotatable between an open position to provide access to an interior portion of the cap for receiving the button therein and a closed position removably secured within the open side of the cap upon rotation of the plate in a direction transverse to the longitudinal axis of the slot.

In accordance with another embodiment of the present invention, there is disclosed a cover for a button secured to an article by a threadlike element, the cover comprising a cap having an open side for receiving a button therein, and a closure plate movably attached to the cap between an opened and closed position with respect to the open side of the cap, the plate having an elongated slot communicating at one end with an enlarged opening at a peripheral portion of the plate, the opening sized to readily receive the threadlike element while the elongated slot sized to receive the threadlike element in engaged relationship with portions of the plate bounding the elongated slot so as to assist in retaining the plate attached to the threadlike element when the cap is in the open position.

In accordance with another embodiment of the present invention, there is disclosed a cover for a button secured to an article by a threadlike element, the cover comprising a cap having an open side for receiving a button therein, a closure plate including an opening for receiving the threadlike element in a placement direction of the plate, a T-shaped member rotatably connecting the plate to the cap, the member including a first leg having one end secured to the plate and another end secured transverse to a second leg at a central location thereof, the second leg having ends received within spaced openings provided in a side wall portion of the cap for relative rotation of the plate about the second leg, the plate rotatable between an opened and closed position with respect to the open side of the cap upon rotation of the plate about the second leg in a direction transverse to the placement direction, the plate including a peripheral projection extending beyond the extent of the cap in a direction transverse to the placement direction, the cap openable upon engagement with the projection upon rotation of the cap about the second leg in a direction transverse to the placement direction, whereby the cap when in the opened position is retained on the article by the threadlike element being retained within the opening.

BRIEF DESCRIPTION OF THE DRAWINGS

The above description, as well as further objects, features and advantages of the present invention will be more fully understood with reference to the following detailed description of a button cover, when taken in conjunction with the accompanying drawings, wherein.

DESCRIPTION OF THE PREFERRED EMBODIMENT

Figure 1:
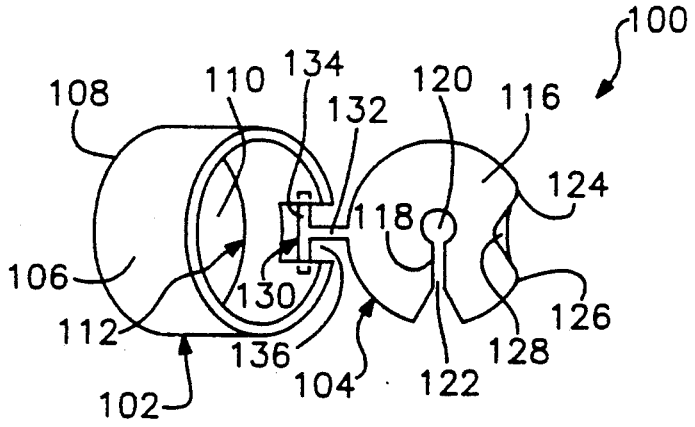
FIG. 1 is a perspective view of a button cover constructed in accordance with the present invention and shown in an opened position.

Referring now to the drawings, wherein like reference numerals represent like elements, there is shown in FIG. 1 a button cover generally designated by reference numeral 100. The button cover 100 is constructed from essentially two elements, namely, a cap 102 and a closure plate 104. The cap 102 is constructed from a cylindrical side wall 106, an end wall 108 and an open side 110 which provides access to the hollow interior 112. The cap 102 is shaped and sized so as to receive a button within the interior 112 as to be described hereinafter. In this regard, the cap 102 may be constructed in other shapes other than cylindrical, such as oval, square and the like. In addition, the end wall 108 may be flat, domed or concaved to provide the desired ornamental effect.

As the button cover 100 is designed to be ornamental in nature, it may be constructed from a variety of precious materials, such as gold or silver, either plated or solid. However, it is to be understood that other non-precious materials may be used, as well as plated plastics. In addition, the exposed face of the end wall 108 may be decorated with precious stones, such as pave diamonds 114, emeralds, rubies and the like. It is also contemplated that the exposed end wall 108 may be decorated with company logos or other indicia.

The closure plate 104 is constructed as a generally circular flat disk 116 dimensioned to be received within the open side 110 of the cap 102. The closure plate 104 is provided with a radially oriented elongated slot 118. The closure plate 104 is further provided with a central opening 120 communicating with one end of the elongated slot 118 and an enlarged V-shaped opening 122 communicating with the other end of the elongated slot. The V-shaped opening 122 opens outwardly along the peripheral edge of the closure plate 104.

Figure 3:
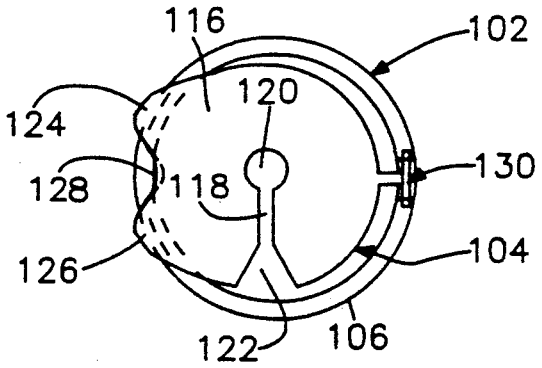
FIG. 3 is a bottom plan view of the button cover constructed in accordance with the present invention and shown in a closed position.

One edge of the closure plate 104 is provided with two spaced projections 124, 126 extending in a direction transverse to the longitudinal axis of the slot 120. The projections 124, 126, as shown in FIG. 3, extend beyond the extent of the side wall 106 of the cap 102. In addition, the projections 124, 126 are curved or displaced slightly away from the plane containing the remainder of the disk 116. This construction of the projections 124, 126 facilitates opening of the button cover 100 upon engagement with the tips of one's fingers or nails as to be described hereinafter.

Figure 2:
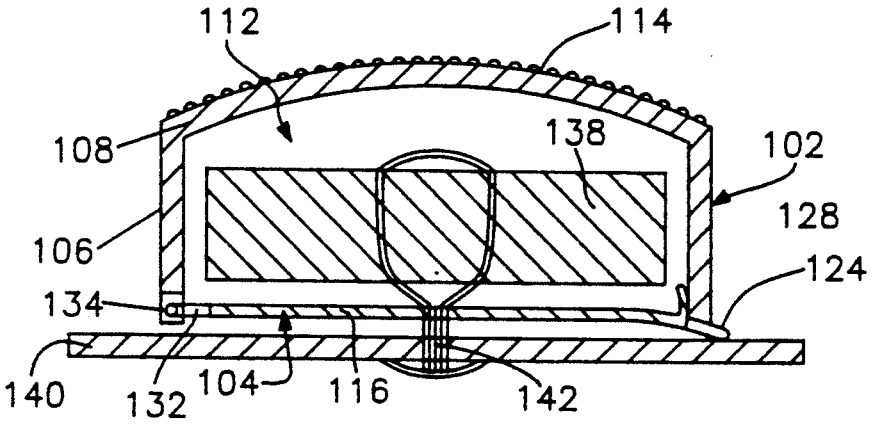
FIG. 2 is a cross-sectional view of a closed button cover installed about a shirt button.

A portion of the disk 116 between the projections 124, 126 is bent upwardly in an opposite direction to form a locking element 128. The locking element 128 is constructed to frictionally engage the interior surface of the side wall 106 when the closure plate 104 is arranged in its closed position as shown in FIG. 2. The locking element 128 prevents the cap 102 from being inadvertently opened during use. The locking element 128 although described as being formed from a portion of the disk 116, may be provided as a separate element attached to the disk if desired. The closure plate 104 may be constructed of similar materials to that of the cap 102. However, as the closure plate 104 is not generally exposed, it may be constructed of non-precious metals, plastic and the like.

The closure plate 104 is attached to the cap 102 by means of a hinge 130. The hinge 130 is constructed as a T-shaped member which may be intricately formed with or separately attached to the peripheral edge of the closure plate 104. Specifically, the hinge 130 includes a first leg 132 having one end secured to the closure plate 104 and a second leg 134 secured transverse to the first leg at a central location thereof. A rectangular cut out 136 is provided in the side wall 106 of the cap 102 to receive the hinge 130. The ends of the second leg 134 extend into spaced openings provided within the opposing walls forming the cut out 136. This construction enables the closure plate 104 to be pivoted or rotated about the longitudinal axis of the second leg 134 between the opened position as shown in FIG. 1 and the closed position as shown in FIGS. 2 and 3.

Referring now to FIG. 2, the application of the button cover 100 will now be described. The button cover 100 is applied to a button 138 which is secured to an article of clothing 140 by means of a plurality of button fastening threads 142 as is conventional. With the button cover 100 in an open position as shown in FIG. 1, the closure plate 104 is slid between the button 138 and article of clothing 140. The threads 142 are accommodated by the closure plate 104 by first being aligned with and readily received by the V-shaped opening 122. As the closure plate 104 is further slid under the button 138 the threads 142 are received within the elongated slot 118 and finally by the opening 120. The elongated slot 118 is constructed to be relatively narrow so as to frictionally engage the threads 142 requiring that a slight amount of force be applied during insertion and removal of the closure plate 104. By sizing the width of the elongated slot 118 to be generally narrower than the dimensions of the threads 142, this has the tendency of preventing the button cover 100 from being dislodged from a button 138 upon inadvertent opening of the cap 102. This restricted opening of the elongated slot 118 also assists in keeping the button cover 100 in place when worn by preventing play with the button fastening threads 142 as is the case with the previously known button covers. The cap 102 is closed and locked in position covering the button 138 upon rotation about hinge 130 until the locking element 128 is frictionally engaged by the interior surface of the side wall 106.

An additional safety feature of the button cover 100 is the opening orientation of the cap 102 with respect to the placement direction of the closure plate 104 and the longitudinal axis of the elongated slot 118. As thus far described, the cap 102 is opened and closed in a direction generally transverse to the placement direction and longitudinal axis of the elongated slot 118. With the cap 102 in its opened position as shown in FIG. 1, the weight of the cap is acting to apply a force in a direction transverse to the longitudinal axis of the elongated slot 118 and against the placement direction of the closure plate 104. In the event of inadvertent opening of the button cover 100 during use, the weight of the cap 102 will pull in a direction which will prevent removal of the closure plate 104 from its secured position underlying a button 138. This safety feature is also aided by the narrow construction of the elongated slot 118 as previously described.

The button cover 100 may be removed by initially engaging the projections 124, 126 with the tip of one's finger or nails and rotating the cap 102 about hinge 134. The button cover 100 may then be removed by sliding the closure plate 104 from between the button 138 and article of clothing 140 in the placement direction along the longitudinal axis of the elongated slot 118. As previously described, a slight force will be required due to the restrictive nature of the elongated slot 118 with respect to the threads 142 securing the button 138.

Although the invention herein has been described with references to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. A button cover for a button secured to an article by a thread-like element, said cover comprising a cap having an unobstructed interior and an open side for receiving a button therein, and a closure plate rotatably attached to said cap about a rotational axis between an opened and closed position with respect to said open side of said cap, said plate including an elongated slot having a longitudinal axis for receiving said thread-like element, said slot opposing said cap when said plate is arranged in said closed position, said plate movable between said opened and closed position by rotation of said plate about said rotational axis in a direction transverse to the longitudinal axis of said slot, said rotational axis of said plate being parallel to said longitudinal axis of said slot.

2. The button cover of claim 1, wherein said closure plate is hinged to said cap by a T-shaped member, said member including a first leg having one end secured to said plate and another end secured transversely to a second leg at a central location thereof, said second leg having ends received within spaced openings provided in a side wall portion of said cap for relative rotation.

3. The button cover of claim 2, wherein said second leg has a longitudinal axis about which said closure plate is rotated, the longitudinal axis of said second leg arranged parallel to the longitudinal axis of said elongated slot.

4. The button cover of claim 1, wherein said closure plate includes a pair of spaced projections extending beyond the extent of said cap when said is in said closed position.

5. The button cover of claim 4, wherein said closure plate includes a locking element arranged between said spaced projections facing said open side of said cap, said locking element frictionally engaging an interior side wall of said cap for releasably securing said plate in said closed position.

6. The button cover of claim 1, wherein said rotational axis of said plate and said longitudinal axis of said slot lie within a common plane when said plate is in both an opened and closed position.

7. The button cover of claim 1, wherein a plane containing the open side of said cap is parallel to a plane containing said slot when said plate is in said closed position.

8. A button cover for a button secured to an article by a threadlike element, said cover comprising a cap having an unobstructed interior and an open side for receiving a button therein, a closure plate including an elongated slot having a longitudinal axis for receiving said thread-like element, said elongated slot communicating at one end with a central opening within said plate and at its other end with an enlarged opening at a peripheral portion of said plate, and connecting means for rotatably connecting said plate to said cap about a rotational axis, said rotational axis of said plate being parallel to said longitudinal axis of said slot, said plate rotatable between an opened position to provide access to said unobstructed interior of said cap for receiving said button therein and a closed position removably secured within said open side of said cap upon rotation of said plate in a direction transverse to the longitudinal axis of said slot, said slot opposing said cap when said plate is arranged in said closed position.

9. The button cover of claim 8, wherein said connecting means comprises a T-shaped member including a first leg having one end secured to said plate and another end secured transverse to a second leg at a central location thereof, said second leg having ends received within spaced openings provided in a side wall portion of said cap for relative rotation of said plate about said second leg.

10. The button cover of claim 9, wherein said second leg has a longitudinal axis about which said closure plate is rotated, the longitudinal axis of said second leg arranged parallel to the longitudinal axis of said elongated slot.

11. The button cover of claim 8, wherein said closure plate includes a pair of spaced projections extending beyond the extent of said cap when said plate is in said closed position.

12. The button cover of claim 11, wherein said closure plate includes a locking element arranged between said spaced projections facing said open side of said cap, said locking element frictionally engaging an interior side wall of said cap for releasably securing said enclosure plate in said closed position.

13. The button cover of claim 8, wherein said closure plate comprises a planar member having at least one projection extending beyond the extent of said cap wherein said closed position, said projection being displaced outwardly away from said one side of said cap.

14. A cover for a button secured to an article by a threadlike element, said cover comprising a cap having an unobstructed interior and an open side for receiving a button therein, a closure plate arrangable between said button and said article and including an elongated opening having a longitudinal axis for receiving said threadlike element in a placement direction of said plate, a T-shaped member rotatably connecting said plate to said cap, said member including a first leg having a longitudinal axis and one end secured to said plate and another end secured transverse to a second leg at a central location thereof, said second leg having ends received within spaced openings provided in a side wall portion of said cap for relative rotation of said plate about said second leg, said longitudinal axis of said opening, said longitudinal axis of said second leg and said placement direction of said plate being parallel to each other, said plate rotatable between an opened and closed position with respect to said open side of said cap upon rotation of said plate about said second leg in a direction transverse to said placement direction, said opening opposing said cap when said plate is in said closed position, said plate including a peripheral projection extending beyond the extent of said cap in a direction transverse to said placement direction, said cap being openable upon engagement with said projection upon rotation of said cap about said second leg in a direction transverse to said placement direction, whereby said cap when in said opened position is retained on said article by said threadlike element being retained within said opening.

15. The button cover of claim 14, further including a pair of spaced projections extending beyond the extent of said housing.

16. The button cover of claim 15, wherein said closure plate includes a locking element arranged between said spaced projections facing said open side of said cap, said locking element frictionally engaging an interior side wall of said cap for releasably securing said plate in said closed position.

17. The button cover of claim 14, wherein said opening within said closure plate comprises an elongated slot communicating at one end with a central opening and at its other end with an enlarged opening at a peripheral portion of said plate.

18. The button cover of claim 14, wherein said longitudinal axis of said second leg and said longitudinal axis of said opening lie within a common plane when said plate is in both an opened and closed position.

* * * * *